US010557638B2

(12) United States Patent
Jewell et al.

(10) Patent No.: US 10,557,638 B2
(45) Date of Patent: Feb. 11, 2020

(54) FAN ASSEMBLY FOR A PACKAGED TERMINAL AIR CONDITIONER UNIT

(71) Applicant: Haier US Appliance Solutions, Inc., Wilmington, DE (US)

(72) Inventors: Robert William Jewell, Louisville, KY (US); Benjamin Justin Riggle, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 122 days.

(21) Appl. No.: 15/818,832

(22) Filed: Nov. 21, 2017

(65) Prior Publication Data

US 2019/0154277 A1 May 23, 2019

(51) Int. Cl.
*F24F 1/027* (2019.01)
*F24F 13/24* (2006.01)

(52) U.S. Cl.
CPC ..... *F24F 1/027* (2013.01); *F24F 13/24* (2013.01)

(58) Field of Classification Search
CPC ..... F24F 1/027; F24F 13/20; F24F 1/0007; F24F 13/224; F24F 2221/20
See application file for complete search history.

(56) References Cited

U.S. PATENT DOCUMENTS

| | | | | |
|---|---|---|---|---|
| 3,727,424 | A | 4/1973 | Edens et al. | |
| 4,480,533 | A | 11/1984 | Bolton et al. | |
| 4,877,106 | A | 10/1989 | Neville et al. | |
| 6,231,704 | B1 | 5/2001 | Carpinetti | |
| 6,708,949 | B2 | 3/2004 | Twito | |
| 7,014,423 | B2 | 3/2006 | Parker et al. | |
| 8,325,478 | B2 | 12/2012 | Siracki et al. | |
| 9,228,591 | B2 | 1/2016 | Choi et al. | |
| 9,383,115 | B2 | 7/2016 | Siegel et al. | |
| 2007/0215614 | A1* | 9/2007 | Matsui | H02G 3/088 220/3.2 |
| 2013/0120943 | A1* | 5/2013 | Tamura | H05K 5/0052 361/752 |
| 2016/0313014 | A1* | 10/2016 | Phillips | F24F 13/20 |
| 2017/0176028 | A1* | 6/2017 | Jeon | F24F 1/22 |
| 2019/0003732 | A1* | 1/2019 | Seo | F24F 11/85 |

FOREIGN PATENT DOCUMENTS

| | | | |
|---|---|---|---|
| CN | 2851927 | Y | 12/2006 |
| CN | 103673140 | A | 3/2014 |
| EP | 2244024 | A1 | 10/2010 |
| JP | H02178538 | A | 7/1990 |
| JP | H0886473 | A | 4/1996 |
| KR | 100765197 | B1 | 10/2007 |
| WO | WO2017013951 | A1 | 1/2017 |

* cited by examiner

*Primary Examiner* — Elizabeth J Martin
(74) *Attorney, Agent, or Firm* — Dority & Manning, P.A.

(57) ABSTRACT

A packaged terminal air conditioner unit (PTAC) includes a vent aperture defined in a bulkhead of the PTAC and a fan assembly for urging a flow of make-up air through the vent aperture. The fan assembly includes a fan duct fluidly coupled to the bulkhead over the vent aperture and an auxiliary fan attached to the fan duct. An electronics assembly includes an electronics enclosure mounted to the fan duct and defining an electronics compartment having an opening for receiving power electronics for controlling the auxiliary fan. A top plate is attachable over the opening and a seal is positioned between the top plate and the electronics enclosure to substantially enclose and seal the electronics compartment.

18 Claims, 14 Drawing Sheets

FAN ASSEMBLY FOR A PACKAGED TERMINAL AIR CONDITIONER UNIT

FIELD OF THE INVENTION

The present disclosure relates generally to air conditioner units, and more particularly to fan assemblies for providing make-up air to packaged terminal air conditioner units.

BACKGROUND OF THE INVENTION

Air conditioner or conditioning units are conventionally utilized to adjust the temperature indoors—i.e. within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected, by e.g., tubing carrying the refrigerant, to another portion located outdoors. These types of units are typically used for conditioning the air in larger spaces.

Another type of unit, sometimes referred to as a packaged terminal air conditioner unit (PTAC), may be used for somewhat smaller indoor spaces that are to be air conditioned. These units may include both an indoor portion and an outdoor portion separated by a bulkhead and may be installed in windows or positioned within an opening of an exterior wall of a building. PTACs often need to draw air from the outdoor portion into the indoor portion. Accordingly, certain PTACs allow for the introduction of make-up air into the indoor space, e.g., through a vent aperture defined in the bulkhead that separates the indoor and outdoor side of the unit.

Conventional PTACs may further include an auxiliary fan and/or make-up air module fluidly coupled with the vent aperture to urge a flow of make-up air from the outdoor side of the PTAC into the conditioned room. In addition, PTACs typically include an electronics enclosure for housing the control electronics for the auxiliary fan, e.g., such as a power inverter or control electronics. Such electronics enclosures are frequently positioned remotely from the auxiliary fan, such as indoors where exposure to moisture is less likely. However, to simplify wire routing and installation, it is desirable to position the electronics enclosure proximate to the auxiliary fan, e.g., outside. Notably, such positioning exposes the electronics enclosure to potentially wet conditions, e.g., due to the outside environment, water splatter from the outdoor fan, etc. In addition, certain conventional electronics enclosures are not rigid enough to contain potential capacitor explosions or other electronics failures.

Accordingly, improved air conditioner units and fan assemblies for providing make-up air would be useful. More specifically, a packaged terminal air conditioner unit including a durable and water-resistant electronics enclosure for powering an auxiliary fan would be particularly beneficial.

BRIEF DESCRIPTION OF THE INVENTION

The present subject matter provides a packaged terminal air conditioner unit (PTAC) including a vent aperture defined in a bulkhead of the PTAC and a fan assembly for urging a flow of make-up air through the vent aperture. The fan assembly includes a fan duct fluidly coupled to the bulkhead over the vent aperture and an auxiliary fan attached to the fan duct. An electronics assembly includes an electronics enclosure mounted to the fan duct and defining an electronics compartment having an opening for receiving power electronics for controlling the auxiliary fan. A top plate is attachable over the opening and a seal is positioned between the top plate and the electronics enclosure to substantially enclose and seal the electronics compartment. Additional aspects and advantages of the invention will be set forth in part in the following description, may be obvious from the description, or may be learned through practice of the invention.

In accordance with one embodiment, a packaged terminal air conditioner is provided including a bulkhead defining an indoor portion and an outdoor portion and a vent aperture defined in the bulkhead. A fan duct is attached to the bulkhead and defines a flow passage in fluid communication with the vent aperture. An electronics assembly includes an electronics enclosure mounted to the fan duct and defining an electronics compartment having an opening and a top plate attachable over the opening of the electronics enclosure to substantially enclose the electronics compartment.

In accordance with another embodiment, an electronics assembly for a packaged terminal air conditioner unit is provided. The packaged terminal air conditioner unit includes a bulkhead defining a vent aperture and a fan duct mounted to the bulkhead over the vent aperture. The electronics assembly includes an electronics enclosure mounted to the fan duct and defining an electronics compartment having an opening and a top plate attachable over the opening of the electronics enclosure to substantially enclose the electronics compartment.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
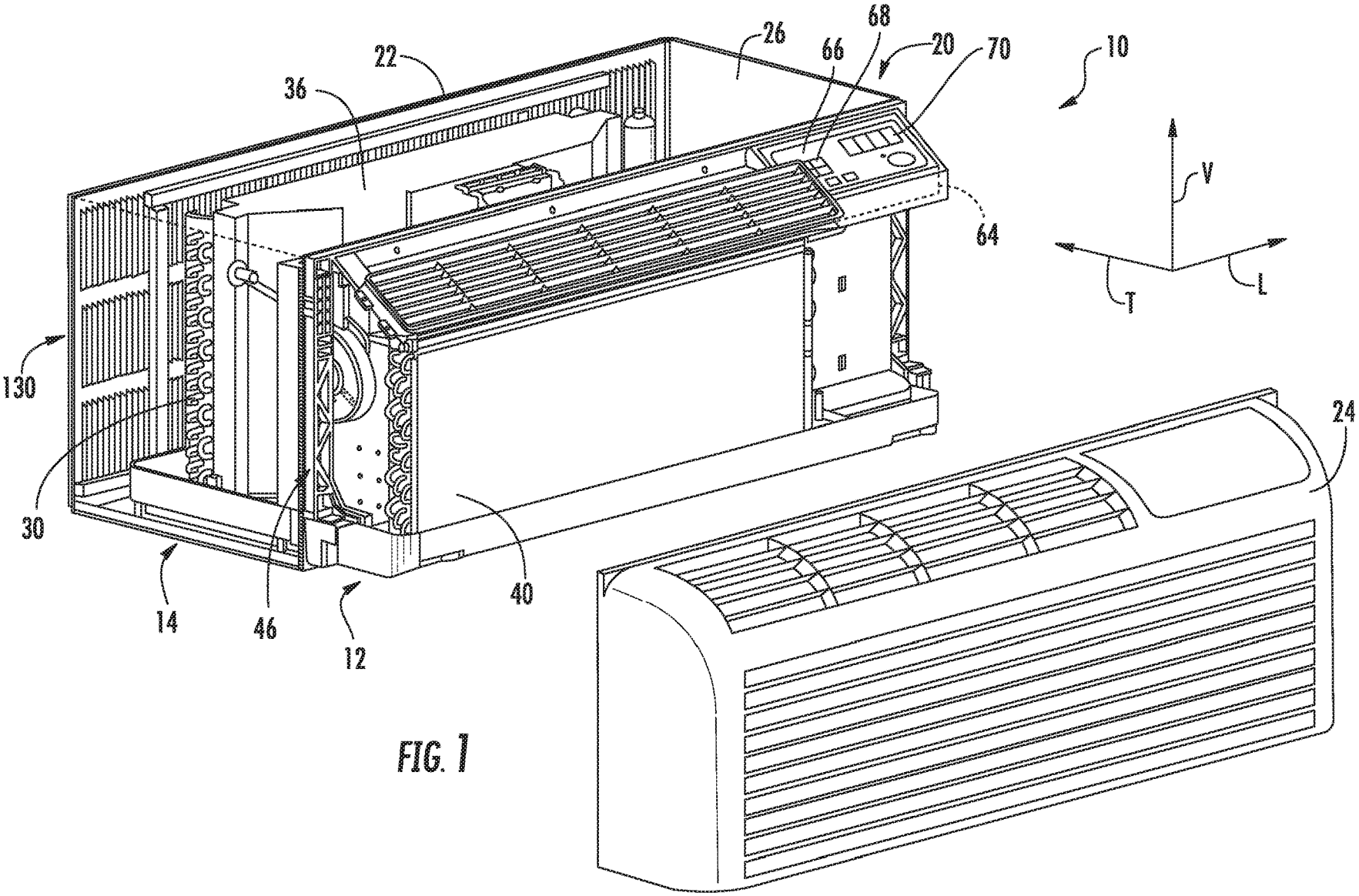
FIG. 1 provides a perspective view of an air conditioner unit, with part of an indoor portion exploded from a remainder of the air conditioner unit for illustrative purposes, in accordance with one exemplary embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
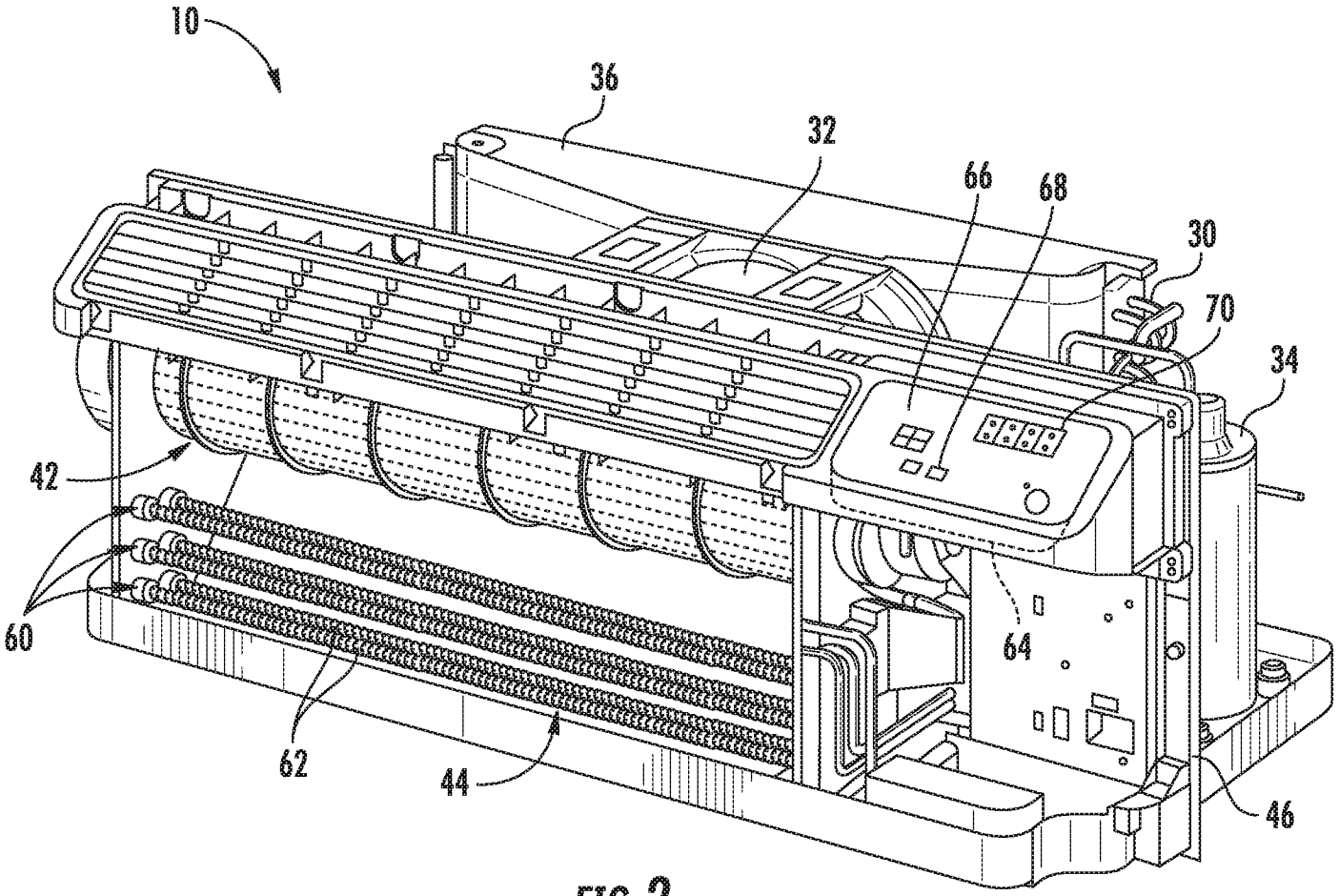
FIG. 2 is another perspective view of components of the indoor portion of the exemplary air conditioner unit of FIG. 1.

Referring now to FIGS. 1 and 2, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32, and a compressor 34 may be housed within the wall sleeve 26. A fan shroud 36 may additionally enclose outdoor fan 32, as shown.

Indoor portion 12 may include, for example, an indoor heat exchanger 40, a blower fan or indoor fan 42, and a heating unit 44. These components may, for example, be housed behind the room front 24. Additionally, a bulkhead 46 may generally support and/or house various other components or portions thereof of the indoor portion 12, such as indoor fan 42 and the heating unit 44. Bulkhead 46 may generally separate and define the indoor portion 12 and outdoor portion 14.

Figure 3:
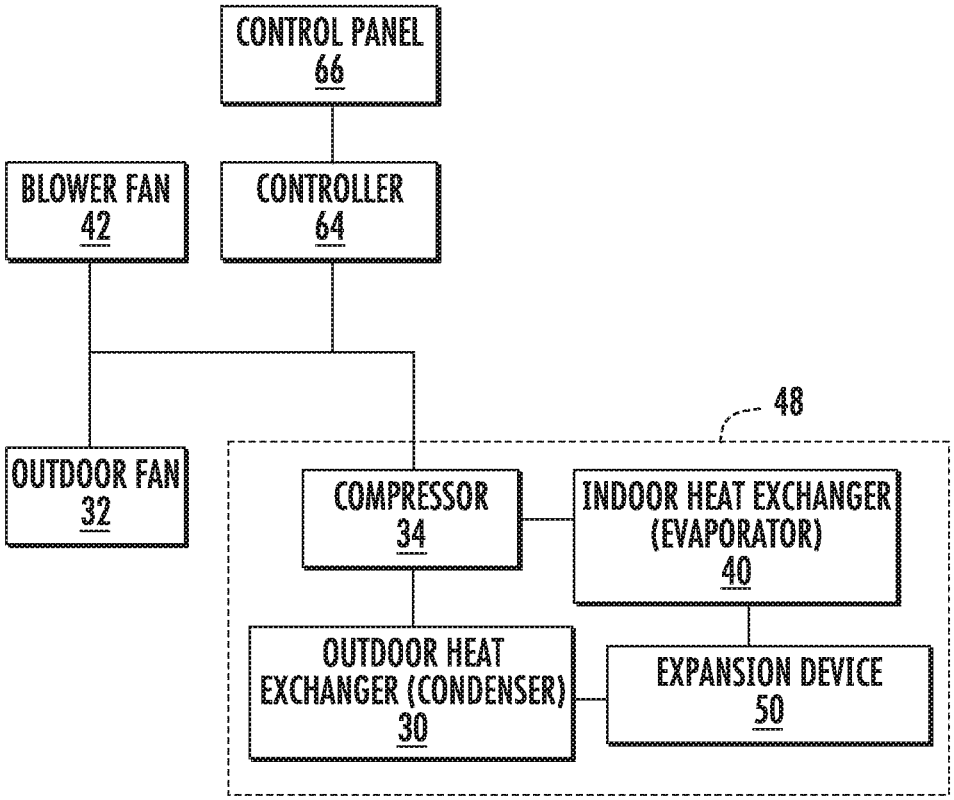
FIG. 3 is a schematic view of a refrigeration loop in accordance with one embodiment of the present disclosure.

Outdoor and indoor heat exchangers 30, 40 may be components of a refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such example and rather that any suitable refrigerant may be utilized.

As is understood in the art, refrigeration loop 48 may be alternately be operated as a refrigeration assembly (and thus perform a refrigeration cycle) or a heat pump (and thus perform a heat pump cycle). As shown in FIG. 3, when refrigeration loop 48 is operating in a cooling mode and thus performs a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment, compressor 34 may be a variable speed compressor. In this regard, compressor 34 may be operated at various speeds depending on the current air conditioning needs of the room and the demand from refrigeration loop 48. For example, according to an exemplary embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

In exemplary embodiments as illustrated, expansion device 50 may be disposed in the outdoor portion 14 between the indoor heat exchanger 40 and the outdoor heat exchanger 30. According to the exemplary embodiment, expansion device 50 may be an electronic expansion valve that enables controlled expansion of refrigerant, as is known in the art. More specifically, electronic expansion device 50 may be configured to precisely control the expansion of the refrigerant to maintain, for example, a desired temperature differential of the refrigerant across the indoor heat exchanger 40. In other words, electronic expansion device 50 throttles the flow of refrigerant based on the reaction of the temperature differential across indoor heat exchanger 40 or the amount of superheat temperature differential, thereby ensuring that the refrigerant is in the gaseous state entering compressor 34. According to alternative embodiments, expansion device 50 may be a capillary tube or another suitable expansion device configured for use in a thermodynamic cycle.

According to the illustrated exemplary embodiment, outdoor fan 32 is an axial fan and indoor fan 42 is a centrifugal fan. However, it should be appreciated that according to alternative embodiments, outdoor fan 32 and indoor fan 42 may be any suitable fan type. In addition, according to an exemplary embodiment, outdoor fan 32 and indoor fan 42 are variable speed fans. For example, outdoor fan 32 and indoor fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed. In addition, according to alternative embodiments, fans 32, 42 may be operated to urge make-up air into the room.

According to the illustrated embodiment, indoor fan 42 may operate as an evaporator fan in refrigeration loop 48 to encourage the flow of air through indoor heat exchanger 40. Accordingly, indoor fan 42 may be positioned downstream of indoor heat exchanger 40 along the flow direction of indoor air and downstream of heating unit 44. Alternatively, indoor fan 42 may be positioned upstream of indoor heat exchanger 40 along the flow direction of indoor air, and may operate to push air through indoor heat exchanger 40.

Heating unit 44 in exemplary embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank 60 may further include at least one heater coil or coil pass 62, such as in exemplary embodiments two heater coils or coil passes 62. Alternatively, other suitable heating elements may be utilized.

The operation of air conditioner unit 10 including compressor 34 (and thus refrigeration loop 48 generally) indoor fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. Controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66, and may be in communication with the controller 64. Display 70 may, for example be a touchscreen or other text-readable display screen, or alternatively may simply be a light that can be activated and deactivated as required to provide an indication of, for example, an event or setting for the unit 10.

Figure 4:
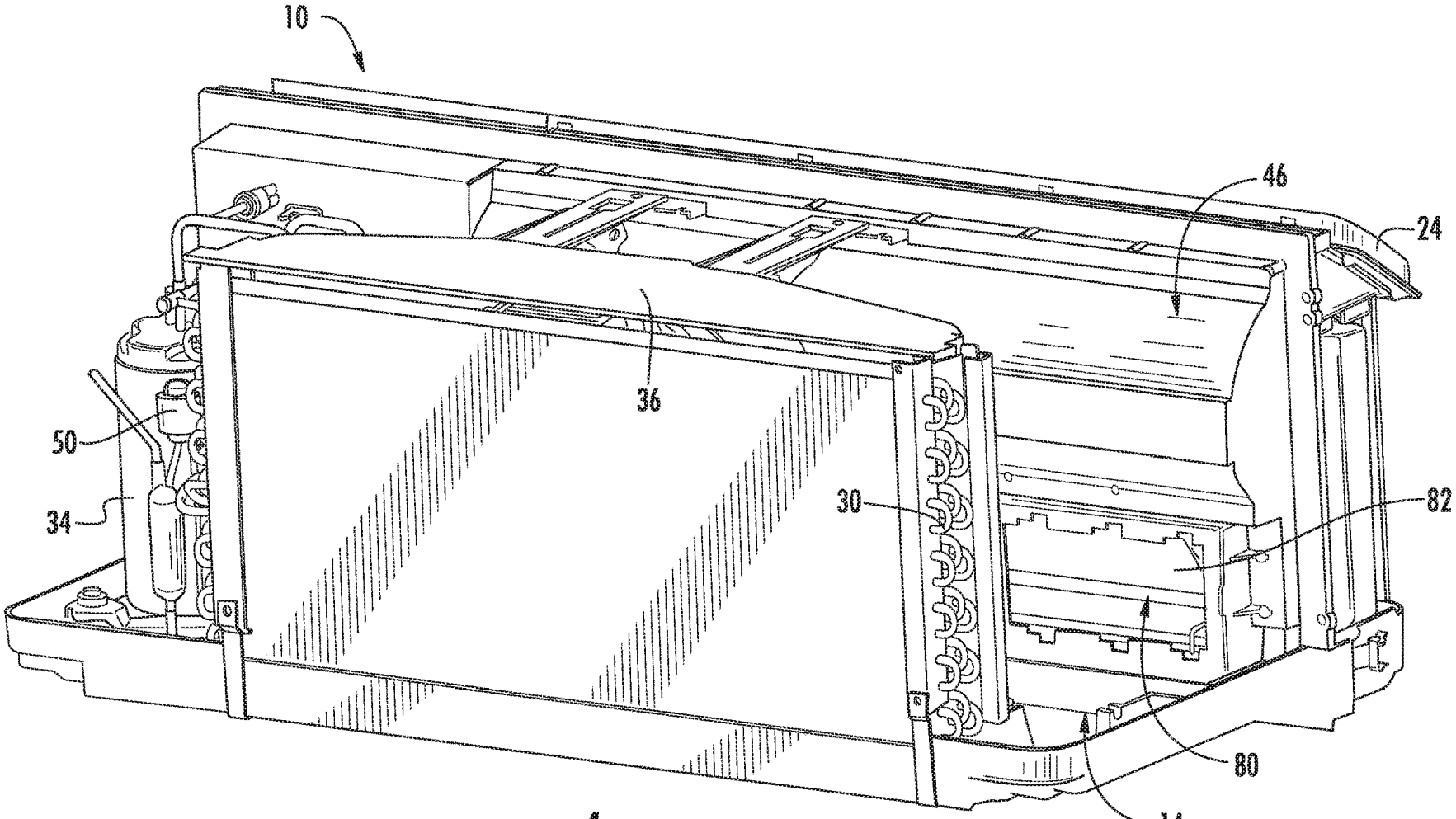
FIG. 4 is a rear perspective view of an outdoor portion of the exemplary air conditioner unit of FIG. 1, illustrating a vent aperture in a bulkhead in accordance with one embodiment of the present disclosure.

Referring briefly to FIG. 4, a vent aperture 80 may be defined in bulkhead 46 providing fluid communication between indoor portion 12 and outdoor portion 14. Vent aperture 80 may be utilized in an installed air conditioner unit 10 to allow outdoor air to flow into the room through the indoor portion 12. In this regard, in some cases it may be desirable to allow outside air (i.e., "make-up air") to flow into the room in order, e.g., to meet government regulations, to compensate for negative pressure created within the room, etc. In this manner, according to an exemplary embodiment, make-up air may be provided into the room through vent aperture 80 when desired.

Figure 5:
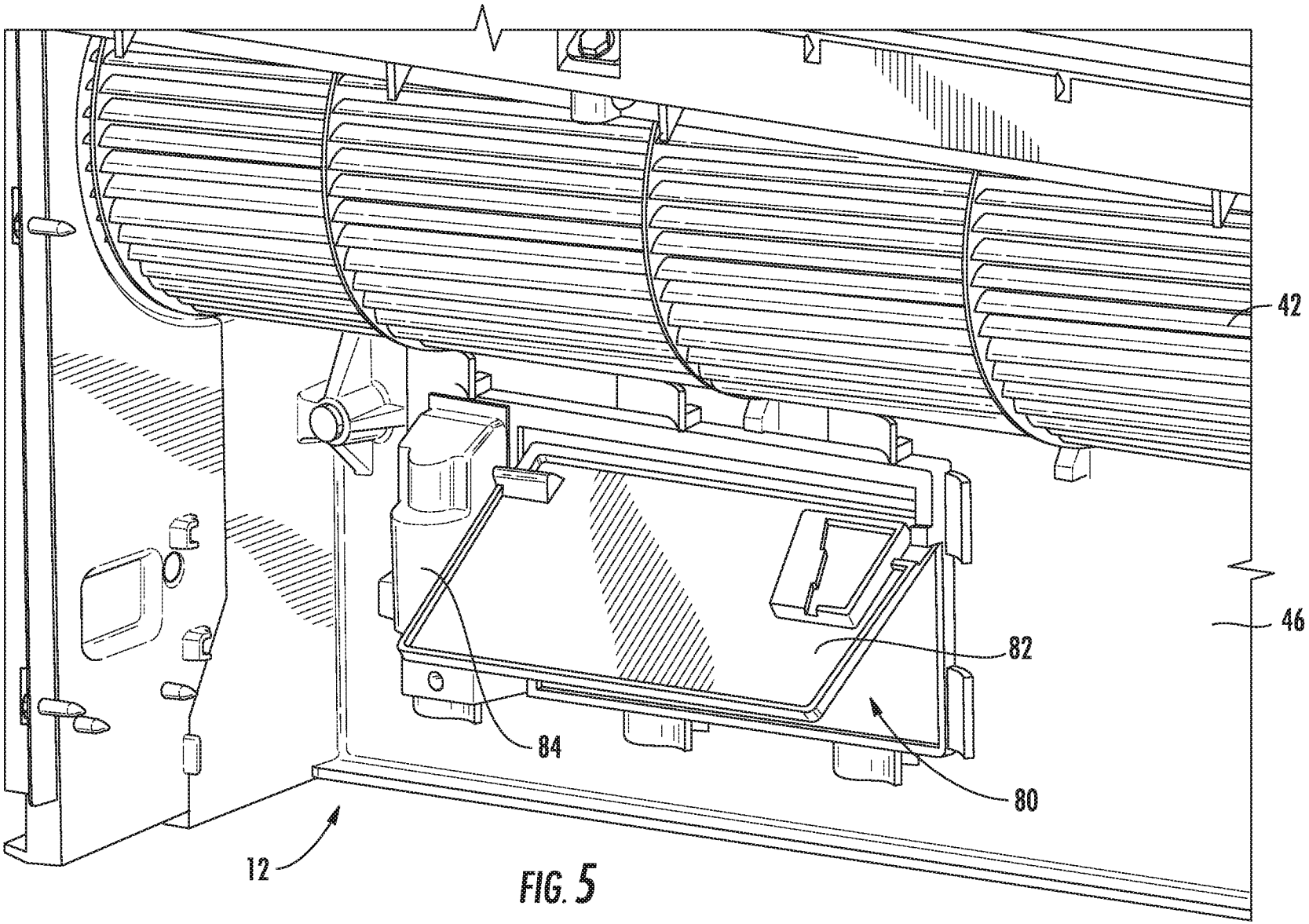
FIG. 5 is a front perspective view of the exemplary bulkhead of FIG. 4 with a vent door illustrated in the open position in accordance with one embodiment of the present disclosure.
Figure 6:
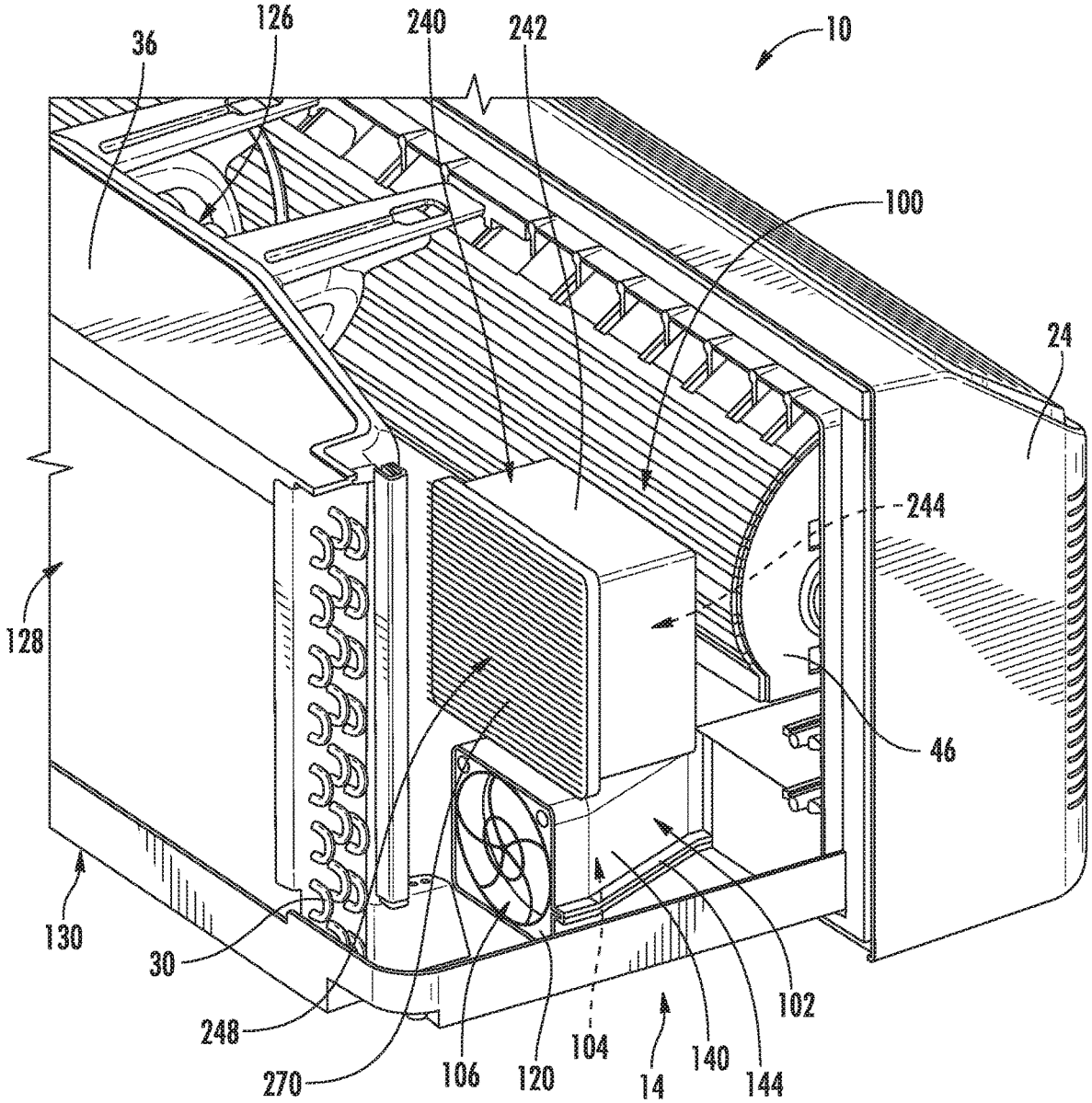
FIG. 6 is a rear perspective view of the exemplary air conditioner unit and bulkhead of FIG. 4 including a fan assembly for providing make-up air in accordance with one embodiment of the present disclosure.

As shown in FIG. 5, a vent door 82 may be pivotally mounted to the bulkhead 46 proximate to vent aperture 80 to open and close vent aperture 80. More specifically, as illustrated, vent door 82 is pivotally mounted to the indoor facing surface of indoor portion 12. Vent door 82 may be configured to pivot between a first, closed position where vent door 82 prevents air from flowing between outdoor portion 14 and indoor portion 12, and a second, open position where vent door 82 is in an open position (as shown in FIG. 5) and allows make-up air to flow into the room. According to the illustrated embodiment vent door 82 may be pivoted between the open and closed position by an electric motor 84 controlled by controller 64, or by any other suitable method.

In some cases, it may be desirable to treat or condition make-up air flowing through vent aperture 80 prior to blowing it into the room. For example, outdoor air which has a relatively high humidity level may require treating before passing into the room. In addition, if the outdoor air is cool, it may be desirable to heat the air before blowing it into the room. Therefore, according to an exemplary embodiment of the present subject matter, unit 10 may further include an auxiliary sealed system that is positioned over vent aperture 80 for conditioning make-up air. The auxiliary sealed system may be a miniature sealed system that acts similar to refrigeration loop 48, but conditions only the air flowing through vent aperture 80. According to alternative embodiments, such as that described herein, make-up air may be urged through vent aperture 80 without the assistance of an auxiliary sealed system. Instead, make-up air is urged through vent aperture 80 may be conditioned at least in part by refrigeration loop 48, e.g., by passing through indoor heat exchanger 40. Additionally, the make-up air may be conditioned immediately upon entrance through vent aperture 80 or sequentially after combining with the air stream induced through indoor heat exchanger 40.

Referring now to FIGS. 6 through 10, a fan assembly 100 will be described according to an exemplary embodiment of the present subject matter. According to the illustrated embodiment, fan assembly 100 is generally configured for urging the flow of makeup air through vent aperture 80 and into a conditioned room without the assistance of an auxiliary sealed system. However, should be appreciated that fan assembly 100 is described herein for the purpose of explaining aspects of the present subject, and that variations and modifications may be made to fan assembly 100 while remaining within scope of the present subject matter. In this regard, fan assembly 100 could be used in conjunction with a make-up air module including an auxiliary sealed system for conditioning the flow of make-up air.

As illustrated, fan assembly 100 includes a fan duct 102 that defines a flow passage 104 that is in fluid communication with vent aperture 80. In this manner, the flow of makeup air may pass through flow passage 104 and vent aperture 80 into the conditioned room or indoor portion 12. More specifically, fan duct 102 may define an inlet 106 and an outlet 108 spaced apart from each other along the transverse direction T. Outlet 108 of fan duct 102 is attached to bulkhead 46 of air conditioner unit 10 to fluidly couple flow passage 104 to vent aperture 80. As will be described in detail below, inlet 106 of fan duct 102 extends away from bulkhead 46 toward rear grill 22 of air conditioner unit 10.

Figure 7:
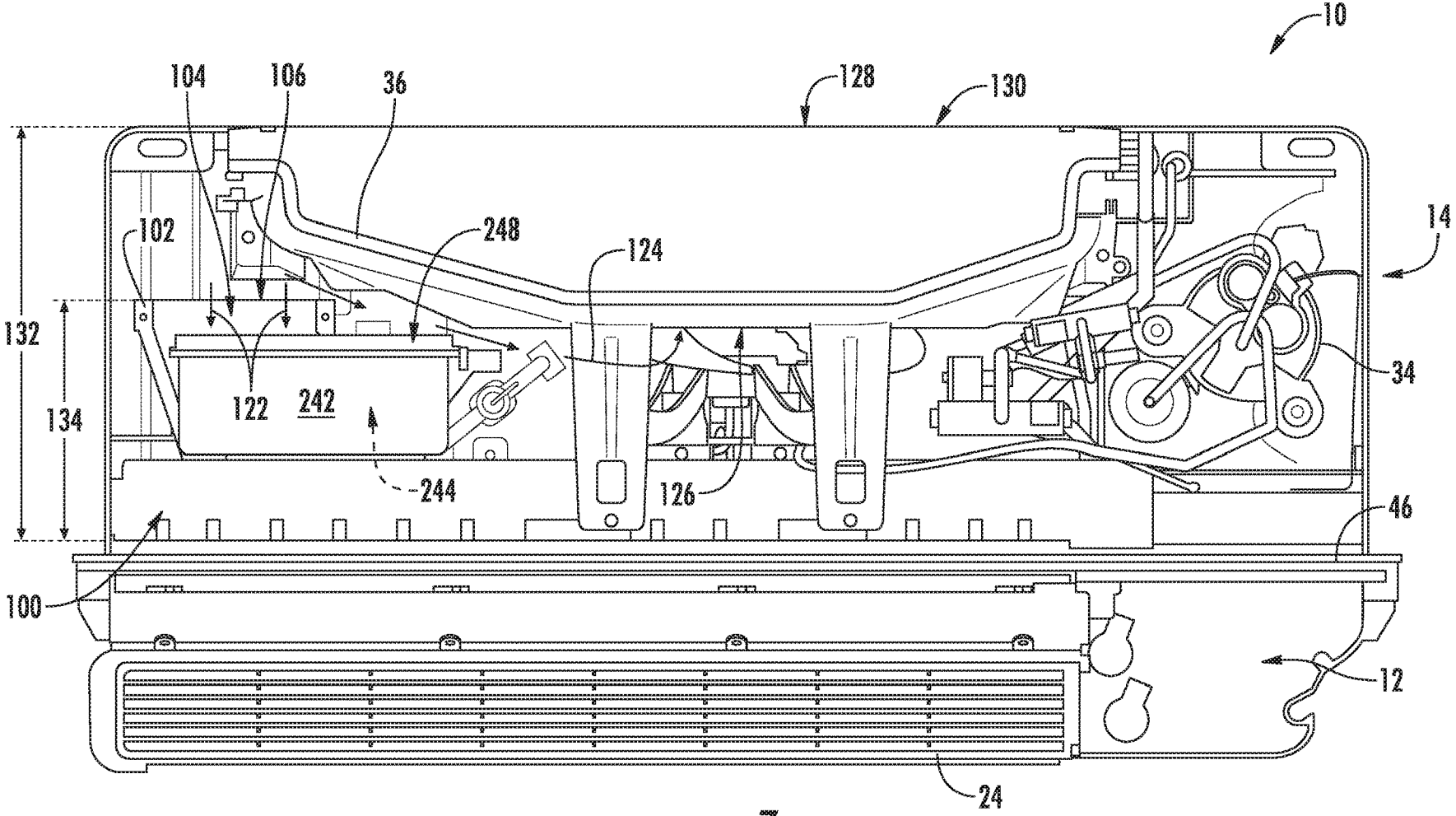
FIG. 7 is a top view of components of the exemplary air conditioner unit of FIG. 1 according to an exemplary embodiment of the present subject matter.
Figure 8:
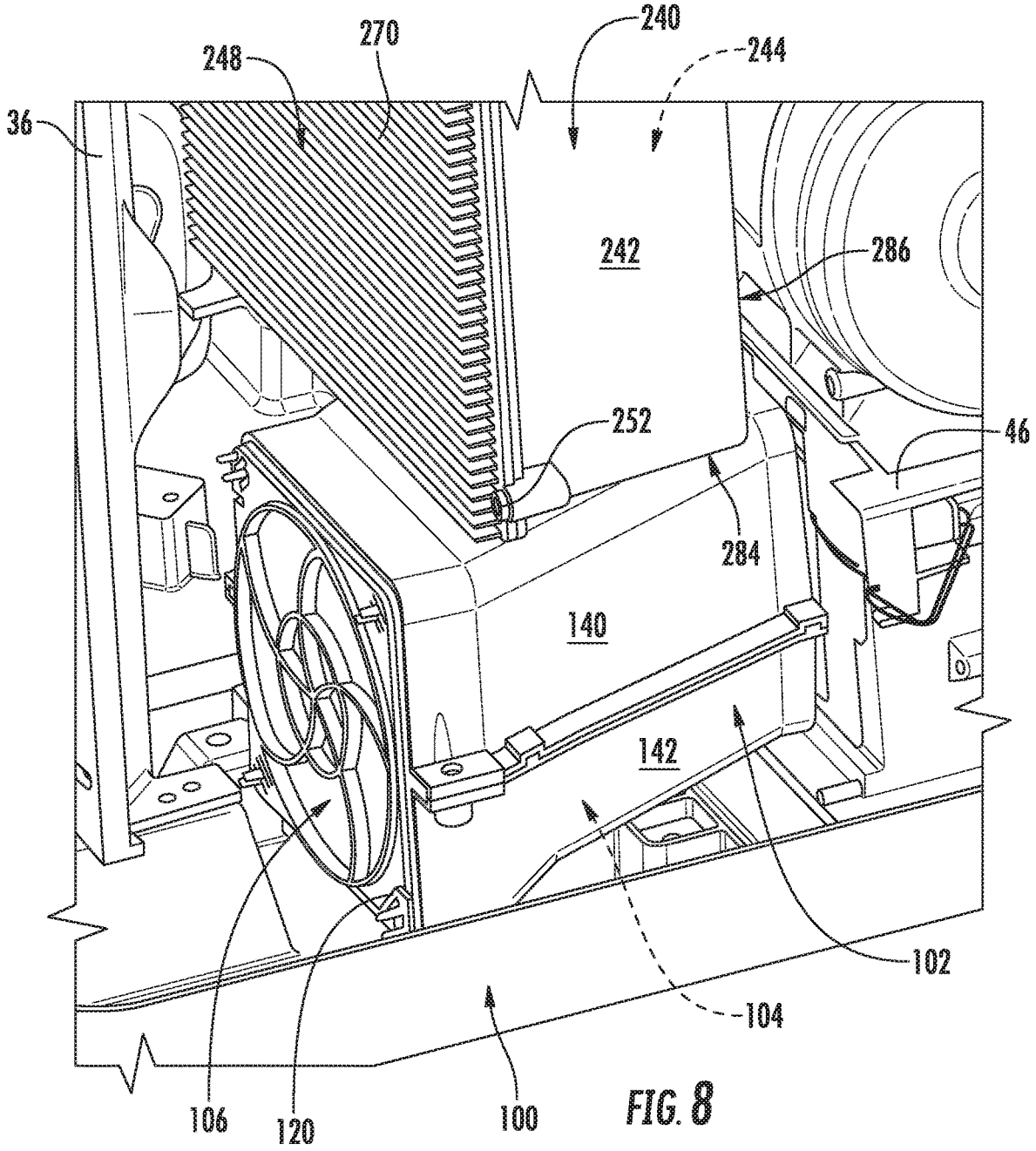
FIG. 8 depicts close-up perspective view of the exemplary fan assembly of FIG. 6 according to example embodiments of the present subject matter.

According to the illustrated embodiment, an auxiliary fan 120 is mounted to fan duct 102 and is generally configured for urging a flow of makeup air (as indicated by arrows labeled with reference numeral 122 in FIG. 7) from outdoor portion 14 through flow passage 104 and vent aperture 80 to indoor portion 12. According to the illustrated embodiment, auxiliary fan 120 is an axial fan. For example, one exemplary axial fan that may be used with fan assembly will be described below in reference to FIG. 14. However, it should be appreciated that any other suitable number, type, and configuration of fan or blower could be used to urge a flow of makeup air according to alternative embodiments.

As illustrated, auxiliary fan 120 is positioned at inlet 106 of fan duct 102, e.g., remote from outlet 108. In addition, fan assembly 100 (including fan duct 102 and auxiliary fan 120) is illustrated as being positioned within outdoor portion 14 of air conditioner unit 10. However, it should be appreciated that fan assembly 100 may be positioned in any other suitable location within air conditioner unit 10 and auxiliary fan 120 may be positioned at any other suitable location within or in fluid communication with fan duct 102. The embodiments described herein are only exemplary and are not intended to limit the scope present subject matter.

As best shown in FIG. 7, outdoor air (as indicated by arrows labeled with reference numeral 124) is circulated through outdoor heat exchanger 30 using outdoor fan 32. More specifically, outdoor fan 32 is surrounded by fan shroud 36 that defines a shroud inlet 126 positioned closer to bulkhead 46 relative to a discharge 128 defined adjacent rear grill 22. In this manner, outdoor fan 32 urges a flow of outdoor air 124 in through rear grill 22 around lateral sides of air conditioner unit 10 and fan shroud 36. The outdoor air is drawn toward shroud inlet 126 and discharged through outdoor heat exchanger 30 and out rear grill 22. Notably, outdoor fan 32 tends to generate negative pressure within outdoor portion 14, particularly in regions closer to shroud inlet 126, bulkhead 46, or vent aperture 80. The negative pressure tends to develop or increase as the outdoor air 124 approaches shroud inlet 126.

According to an exemplary embodiment of the present subject matter, fan duct 102 may define a geometry and be positioned such that inlet 106 is positioned at a location where the negative pressure generated by outdoor fan 32 does not significantly affect the ability of auxiliary fan 120 to draw make-up air 122 into flow passage 104. In this manner, for example, fan duct 102 may extend towards rear grill 22 such that inlet 106 is positioned proximate rear grill 22. According to an exemplary embodiment, inlet 106 may be directly coupled to or defined by rear grill 22. Notably, such positioning of inlet 106 allows auxiliary fan 120 to draw in make-up air 122 without having to compete with outdoor fan 32.

Referring now specifically to FIGS. 6 through 9, inlet 106 of fan duct 102 may be positioned between a rear 130 of air conditioner unit 10 and shroud inlet 126 of fan shroud 36 along the transverse direction T. According still another embodiment, air conditioner unit 10 may define an outside depth 132 between bulkhead 46 and rear grill 22 along the transverse direction T. In addition, the duct length 134 may be defined between inlet 106 and outlet 108 of fan duct 102 along the transverse direction. According to an exemplary embodiment, duct length 134 is greater than or equal to one quarter of outside depth 132, or greater than one half of outside depth 132. Other suitable lengths of fan duct 102 are possible and within scope of the present subject matter.

Figure 9:
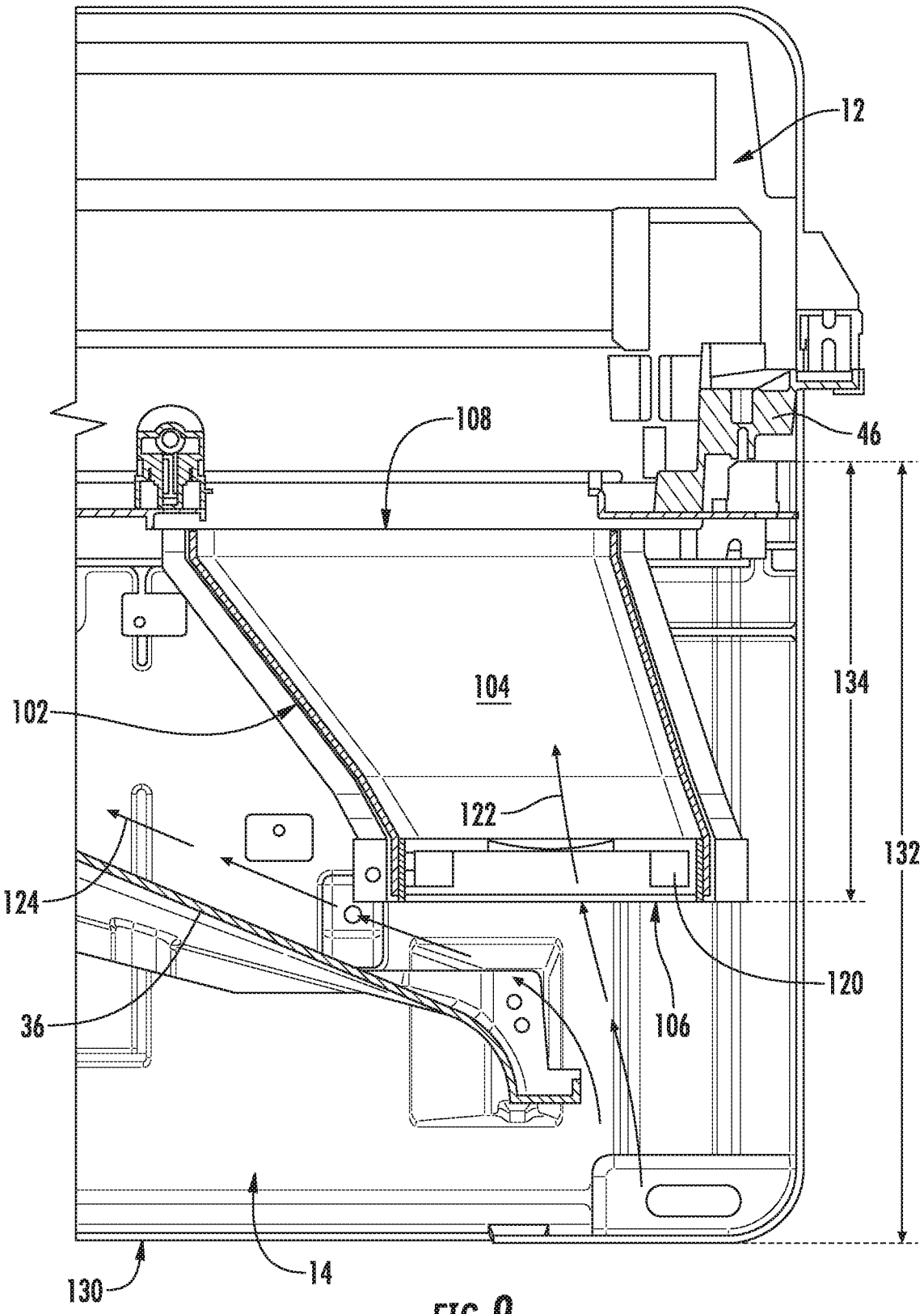
FIG. 9 provides a top, cross sectional view of the exemplary air conditioner unit of FIG. 1 and the exemplary fan assembly of FIG. 6.
Figure 10:
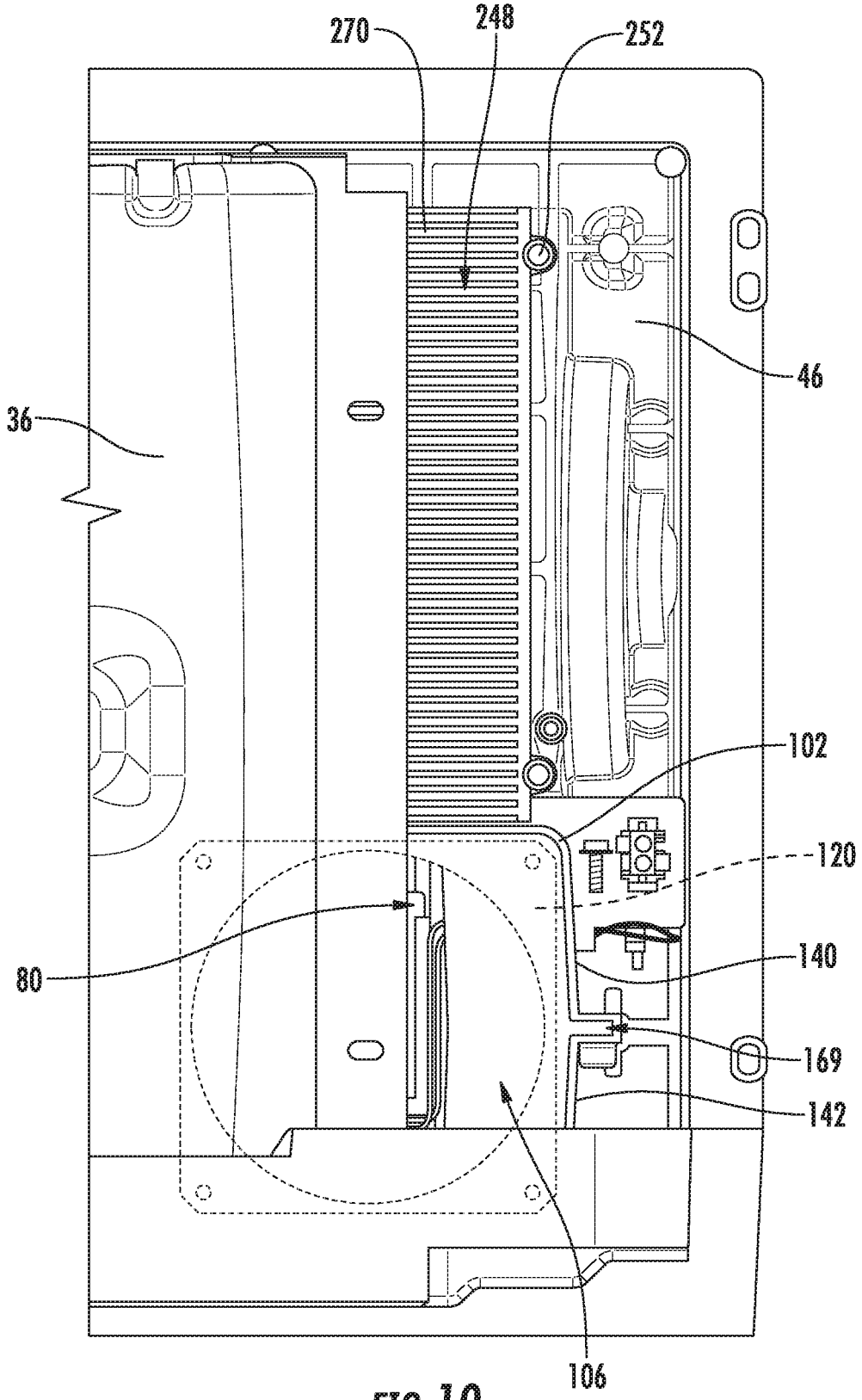
FIG. 10 provides a rear view of the exemplary air conditioner unit of FIG. 1 and the exemplary fan assembly of FIG. 6 with an auxiliary fan illustrated in phantom.

Referring now specifically to FIGS. 7, 9, and 10, fan duct 102 may further be shaped to provide sufficient distance between inlet 106 and shroud inlet 126, e.g., to avoid the negative pressure generated by outdoor fan 32 and to prevent the propagation of noise through fan duct 102. In this regard, the inventors the present subject matter have determined that forming an asymmetric duct that breaks some or all direct line of sight from inlet 106 to outlet 108 may reduce noise transmitted to indoor portion 12. Therefore, according to the illustrated embodiment, fan duct 102 is asymmetric when viewed along a horizontal plane (e.g., defined by lateral direction L and transverse direction T) such that inlet 106 and outlet 108 are offset along the transverse direction T. In this regard, according to one exemplary embodiment, there is limited line of sight from inlet 106 to outlet 108 of fan duct 102. For example, as shown in FIG. 10, only a fraction of vent aperture 80 may be seen through inlet 106 when looking along the transverse direction T (such as less than 25 percent, 10 percent, or even less than 5 percent of the total area of vent aperture 80). According to another embodiment, there is no direct line of sight from inlet 106 to outlet 108 along the transverse direction T.

Notably, fan duct 102 may be formed by injection molding, e.g., using a suitable plastic material, such as injection molding grade high impact polystyrene (HIPS) or acrylonitrile butadiene styrene (ABS). Alternatively, according to the exemplary embodiment, fan duct 102 is compression molded, e.g., using sheet molding compound (SMC) thermoset plastic. However, difficulties may arise in using such manufacturing techniques due to the complex geometry of fan duct 102. For example, some mold tools may not be capable of forming an asymmetric fan duct in one piece without complex tooling, post processing, or other manufacturing procedures. Therefore, according to an exemplary embodiment of the present subject matter, fan duct 102 includes an upper portion 140 and a lower portion 142 that are separately formed, e.g., via compression molding, and are subsequently joined to form fan duct 102.

Figure 11:
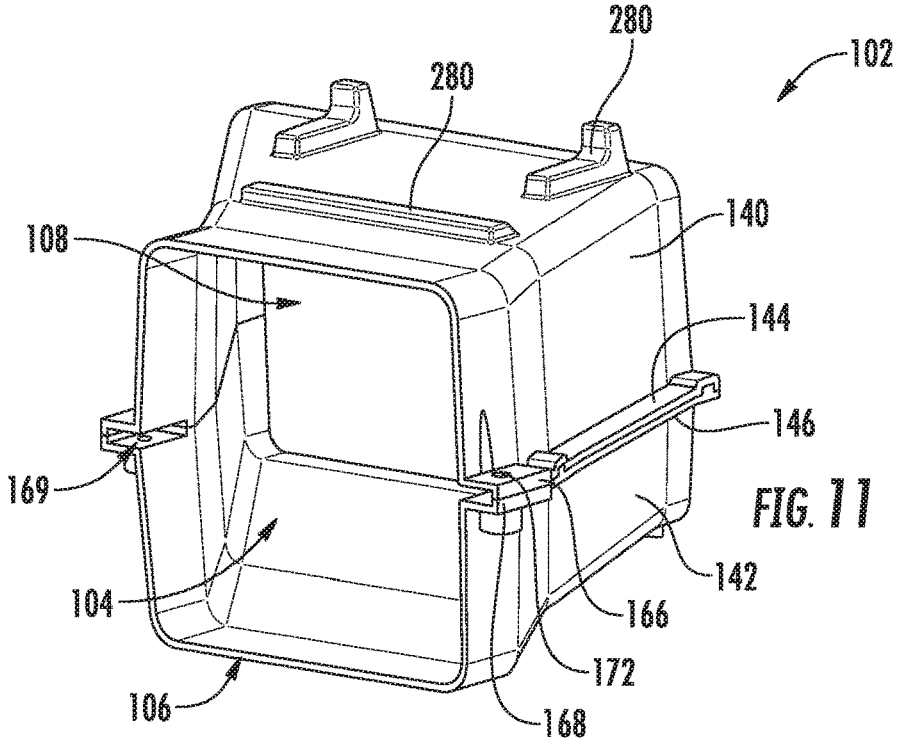
FIG. 11 provides a perspective view of a fan duct of the exemplary fan assembly of FIG. 6 according to an exemplary embodiment of the present subject matter.
Figure 12:
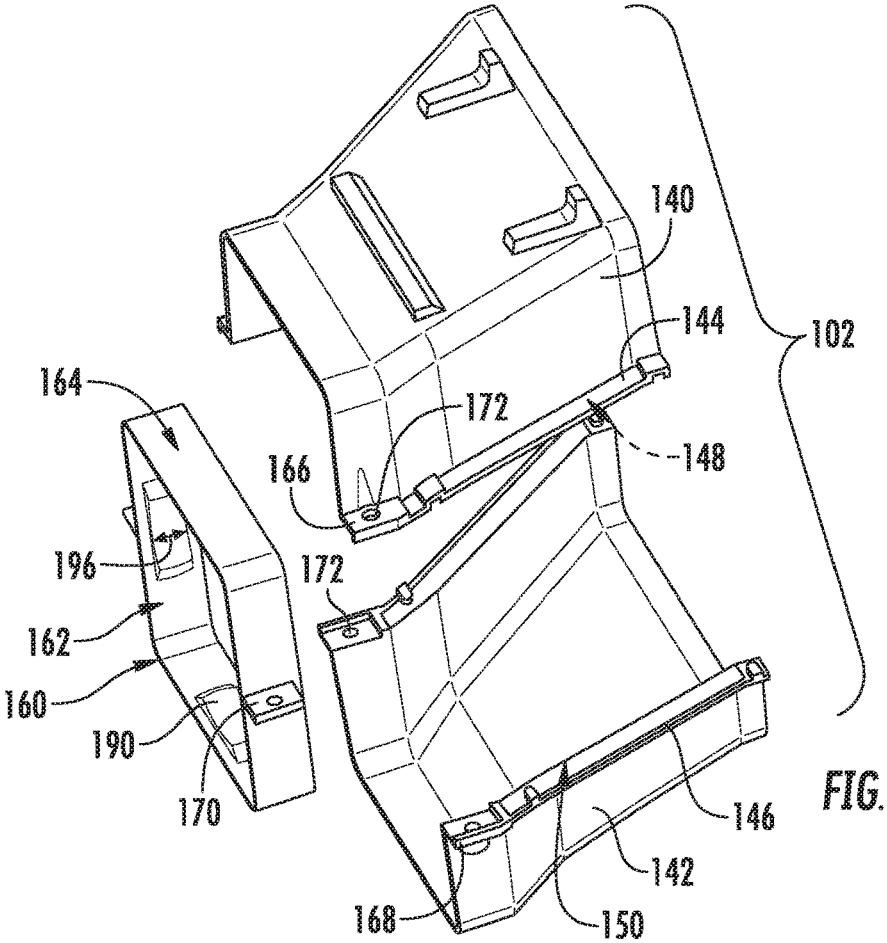
FIG. 12 provides an exploded view of the exemplary fan duct of FIG. 11.

More specifically, referring to FIGS. 11 and 12, upper portion 140 may be an upper half of fan duct 102 and lower portion 142 may be lower half of fan duct 102. To facilitate the joining of upper portion 140 and lower portion 142, upper portion 140 may define an upper flange 144 and lower portion 142 may define a lower flange 146 that extend along a length of fan duct 102. Upper flange 144 and lower flange 146 may be joined together in any suitable manner. For example, upper flange 144 and lower flange 146 may be joined using one or more mechanical fasteners, such as screws, bolts, rivets, etc. Alternatively, glue, welding, snap-fit mechanisms, interference-fit mechanisms, or any suitable combination thereof may join upper flange 144 and lower flange 146.

According to the illustrated embodiment, upper flange 144 and lower flange 146 are joined using an adhesive. In this regard, upper flange 144 may define an upper channel 148 and lower flange 146 may define a lower channel 150 which are shaped for receiving an adhesive. During assembly, the upper channel 148 and the lower channel 150 are filled with adhesive and upper flange 144 is clamped together with lower flange 146 until the adhesive cures to form fan duct 102.

According to an exemplary embodiment, fan assembly 100 may further include an isolation member 160 that is positioned between auxiliary fan 120 and fan duct 102. Isolation member 160 may be formed from an elastomeric or rubber material, such as silicone or a thermoplastic elastomer. In general, isolation member 160 is designed to absorb vibrations generated by auxiliary fan 120 during operation. In this manner, isolation member 160 prevents these vibrations from propagating through fan duct 102 and generating noise inside indoor portion 12.

Figure 13:
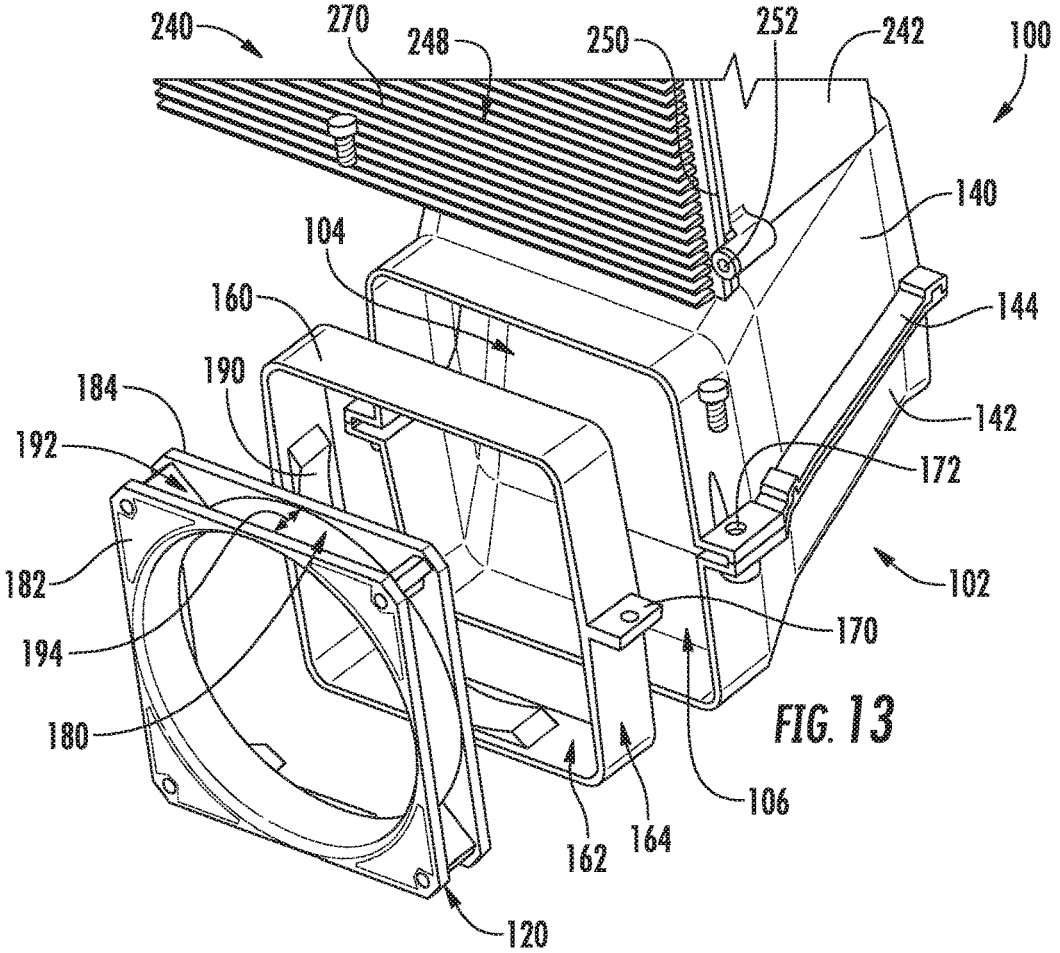
FIG. 13 provides a partially exploded view of the exemplary fan assembly of FIG. 6.

Referring specifically to FIGS. 11 through 13, isolation member 160 is positioned around auxiliary fan 120 and within fan duct 102. In this regard, for example, isolation member 160 generally defines an inner surface 162 and an outer surface 164. Inner surface 162 is configured for engaging auxiliary fan 120 and outer surface 164 is configured for engaging fan duct 102. More specifically, to couple isolation member 160 to fan duct 102, upper portion 140 of fan duct 102 may further define an upper bracket 166 and lower portion 142 of fan duct 102 may further define a lower bracket 168. When upper portion 140 and lower portion 142 are joined to form fan duct 102, a bracket gap 169 (see FIG. 11) is defined between upper bracket 166 and lower bracket 168.

Isolation member 160 further defines one or more isolation flanges 170 which are sized for receipt in bracket gap 169 between upper bracket 166 and lower bracket 168. In addition, screw holes 172 may be defined through upper bracket 166, lower bracket 168, and isolation flange 170 for receiving a mechanical fastener. In this manner, isolation member 160 may be secured within fan duct 102. Although upper portion 140 and lower portion 142 of fan duct 102 are illustrated herein as being joined both by an adhesive and a mechanical fastener, it should be appreciated that any suitable means for connecting the two may be used according to alternative embodiments. For example, upper bracket 166 and lower bracket 168 could instead be extensions of flanges 144, 146 and could be assembled using an adhesive.

According to the illustrated embodiment, auxiliary fan 120 defines an axial direction A, a radial direction R, and a circumferential direction C. In addition, auxiliary fan 120 defines a fan perimeter 180 which is substantially circular and positioned between an upstream flange 182 and a downstream flange 184 which are separated along the axial direction A. According to the illustrated embodiment, isolation member 160 extends all the way around the entire fan perimeter 180. More specifically, isolation member 160 is substantially rectangular and includes four sides. Isolation member 160 further defines a plurality of complementary mating features 190 that extend from inner surface 162 toward auxiliary fan 120 for securing auxiliary fan 120. For example, the complementary mating features 190 may be curved or arcuate members that engage fan perimeter 180 to secure auxiliary fan 120 in place. As used herein, terms of approximation, such as "approximately," "substantially," or "about," refer to being within a ten percent margin of error.

Notably, complementary mating features 190 may also be sized for securing the axial position of his auxiliary fan 120 within fan duct 102. In this regard, for example, auxiliary fan 120 defines a flange gap 192 between upstream flange 182 and downstream flange 184 along the axial direction A. Complementary mating features 190 are positioned within flange gap 192 to prevent auxiliary fan 120 from moving axially. More specifically, for example, flange gap 192 may define a gap width 194 along the axial direction A that is substantially the same as the feature width 196 defined by the complementary mating feature 190 along the axial direction A. Although four complementary mating features 190 are illustrated as positioned on each side of a rectangular isolation member 160, it should be appreciated that any suitable number, size, and position of mating features may be used according to alternative embodiments.

Although auxiliary fan 120 is illustrated above as being directly mounted within fan duct 102, it should be appreciated that according to alternative embodiments, fan assembly 100 could instead include a fan mounting structure that is separately assembled and attached to fan duct 102. In this manner, according to alternative embodiments, auxiliary fan 120 may be inserted into isolation member 160 and then installed onto the fan mounting structure. The fan mounting structure could then be separately installed onto a fan duct before mounting to bulkhead 46. Other configurations and constructions are possible and within the scope of the present subject matter.

In sum, isolation member 160 and the fan installation method and configuration described above can isolate auxiliary fan 120 from fan duct 102 and reduce noise generated by auxiliary fan 120 while providing make-up air. In this regard, by positioning an elastomeric or rubber material between auxiliary fan 120 and fan duct 102 (or any other suitable fan mounting structure), vibrations transferred to fan duct 102 may be reduced significantly. Isolation member 160 may be formed in a band around fan perimeter 180 of auxiliary fan 120 and may include various protrusions or other features, e.g., mating features 190, for locating and securing auxiliary fan 120 in position within fan duct 102. In addition, isolation member 160 may define one or more isolation flanges 170 that may be secured to fan duct 102 during assembly, thereby fixing isolation member 160 and auxiliary fan 120 relative to fan duct 102.

Isolation member 160 thus provides a unique means of locating and retaining an auxiliary fan within a fan duct while isolating or damping vibrations generated during fan operation. Isolating the fan as a noise source will reduce or eliminate noise which may be a nuisance to occupants of the conditioned room and otherwise result in a more desirable consumer experience. Other configurations of fan duct 102 and isolation member 160, as well as associated benefits and advantages of such constructions, will be apparent to those having skill in the art.

Figure 14:
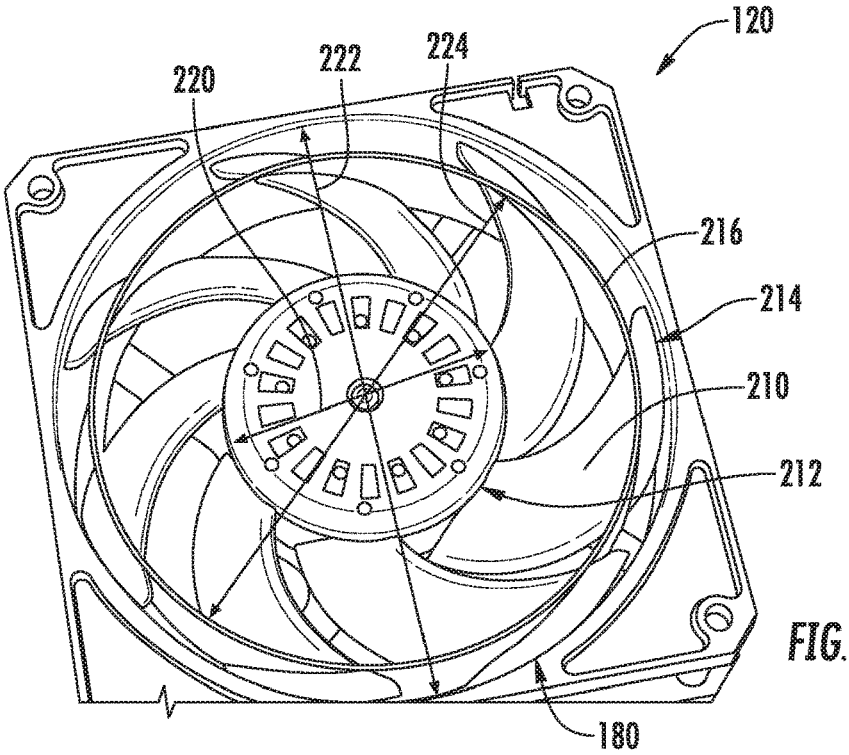
FIG. 14 provides a perspective view of an auxiliary fan that may be used with the exemplary fan assembly of FIG. 6.

Referring now to FIG. 14, auxiliary fan 120 will be described according to an exemplary embodiment of the present subject matter. It should be appreciated that the auxiliary fan 120 illustrated in FIG. 14 and described herein is only one exemplary configuration of auxiliary fan 120. As illustrated, auxiliary fan 120 defines an axial direction A, a radial direction R, and a circumferential direction C. Auxiliary fan 120 includes a plurality of fan blades 210 that generally extend between a root 212 and a tip 214. According to the illustrated embodiment, fan blades 210 includes seven blades positioned equidistantly about the circumferential direction C. Fan blades 210 are sized, spaced, and define a twist or camber that allow fan blades 210 to block a substantial portion of noise trying to pass through auxiliary fan 120, e.g., when auxiliary fan 120 is off. However, it should be appreciated that according to alternative embodiments, any suitable number, size, and geometry of fan blades 210 may be used.

In addition, auxiliary fan 120 includes a stabilizer ring 216 that extends about the circumferential direction C to couple fan blades 210. Stabilizer ring 216 is a generally rigid circular member configured to provide rigidity between fan blades 210 to prevent "growl" or "flutter" of fan blades 210, particularly during transient operation when the speed of auxiliary fan 120 changing. Stabilizer ring 216 is preferably positioned proximate tips 214 of fan blades 210, where blade distortion or flutter might be most extreme.

More specifically, according to the illustrated embodiment, fan blades define a root diameter 220 and a tip diameter 222. In addition, stabilizer ring 216 defines a ring diameter 224. According to an exemplary embodiment, ring diameter 224 is between about 50% greater than a root diameter 220 and 10% less than tip diameter 222. According to still another embodiment, ring diameter 224 is substantially the same as tip diameter 222. In addition, stabilizer ring 216 may be positioned only at a forward most end of blades 210 along the axial direction A, the aft most end of blades 210 along the axial direction A, or at both. Moreover, according to the illustrated embodiment, blades 210 may define a blade depth along the axial direction A and the stabilizer ring 216 may extend substantially along the entire blade depth of fan blades 210.

Figure 15:
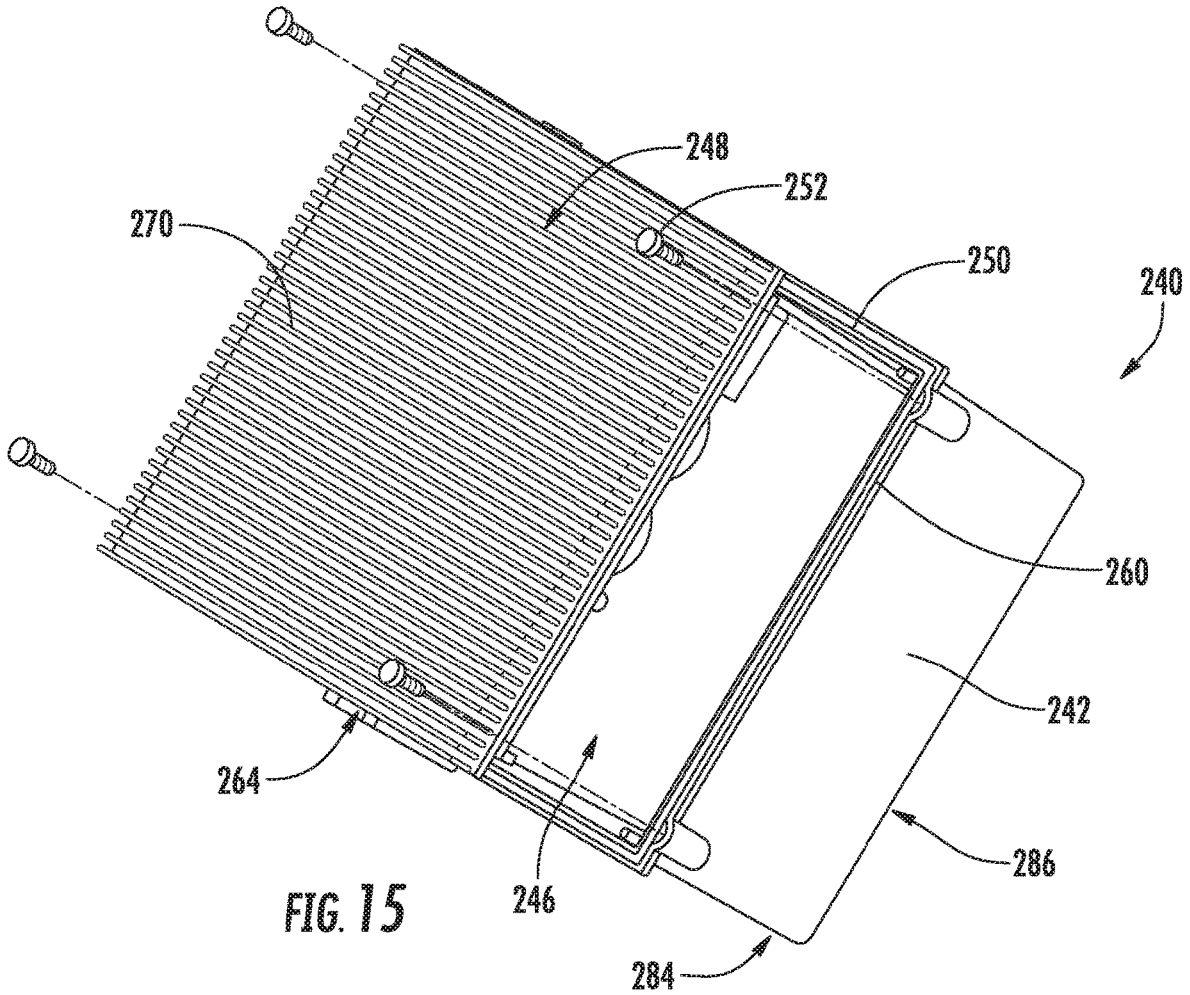
FIG. 15 provides an exploded view of an electronics assembly of the exemplary fan assembly of FIG. 6.
Figure 16:
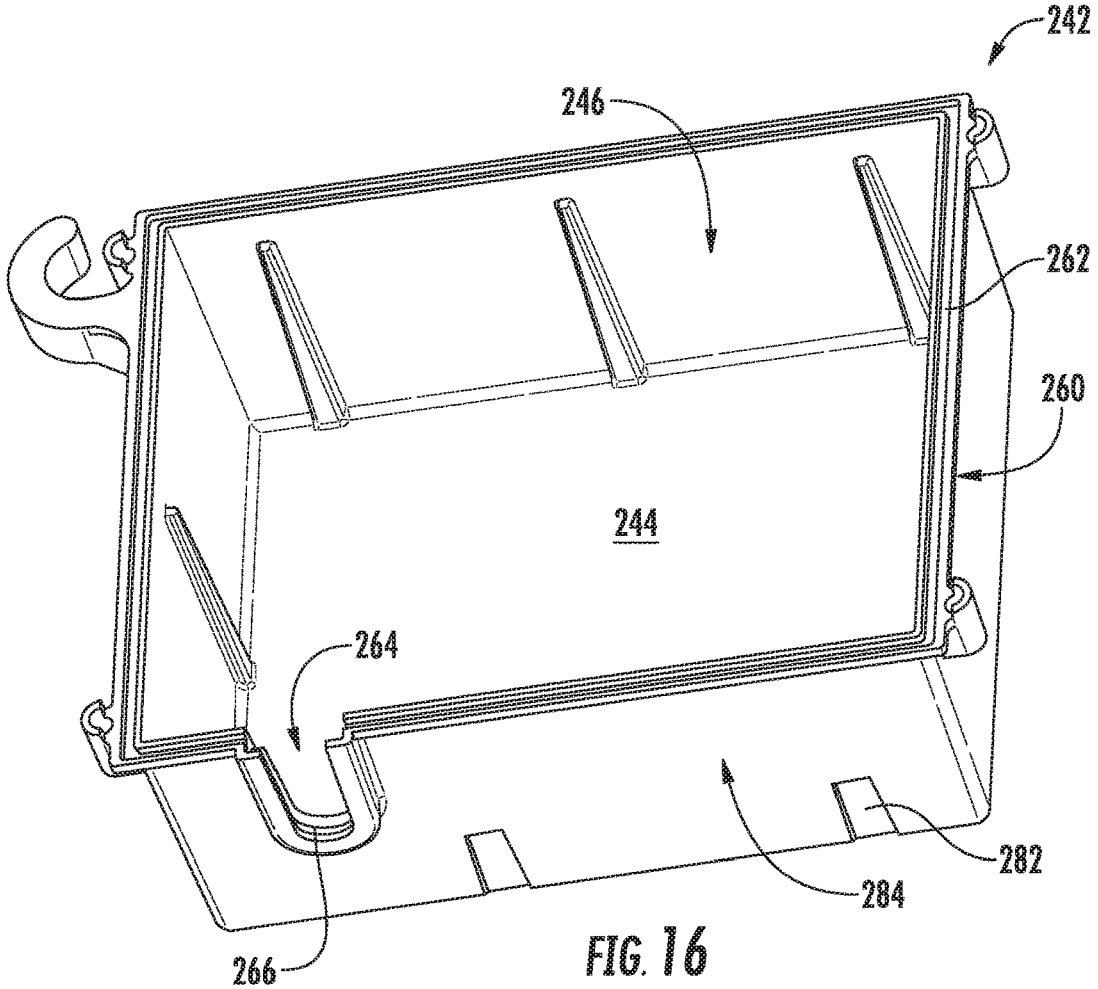
FIG. 16 provides a front perspective view of an electronics enclosure of the exemplary electronics assembly of FIG. 15.
Figure 17:
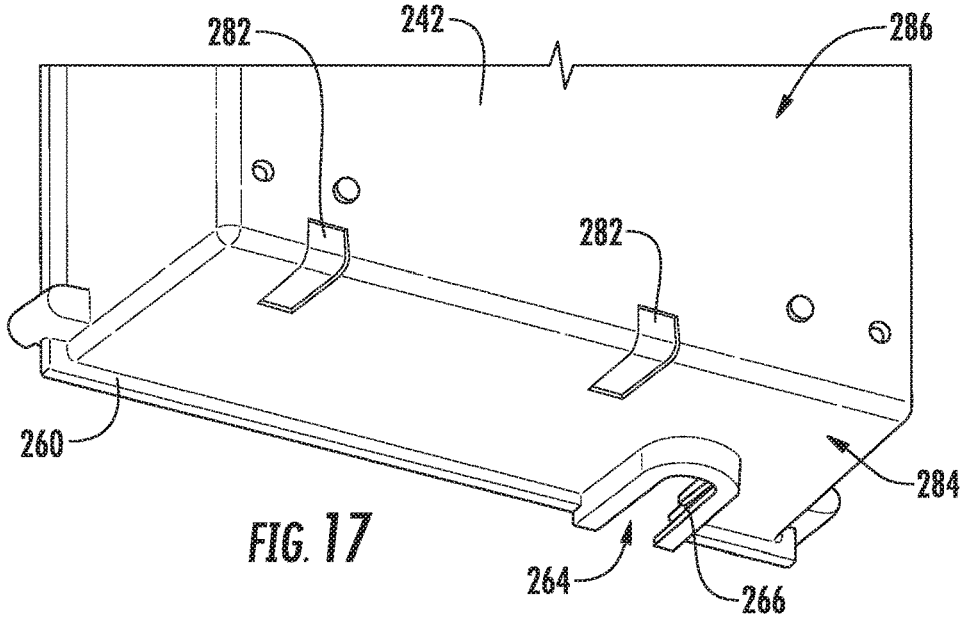
FIG. 17 provides a rear perspective view of the exemplary electronics enclosure of FIG. 16.

Referring now to FIGS. 15 through 17, fan assembly 100 further includes an electronics assembly 240 which is generally configured for housing electronic components used for driving auxiliary fan 120, vent door 82, or any other components of air conditioner unit 10. In general, electronics assembly 240 includes an electronics enclosure 242 that is mounted to fan duct 102 and generally defines an electronics compartment 244 that is used for housing electronic components. For example, according to exemplary embodiments, controller 64 (or any other suitable control electronics) may be housed within electronics enclosure 242, such that auxiliary fan 120 may be controlled by controller 64. In addition, an inverter or other power electronics may be stored within electronics enclosure 242 to convert or rectify an input power to a pulse with modulated (PWM) signal as needed for driving auxiliary fan 120.

More specifically, electronics enclosure 242 may be a five sided box defining an opening 246 through which electronic components may be inserted into electronics compartment 244. Electronics assembly 240 may further include a top plate 248 that is attachable over opening 246 of electronics enclosure 242 to substantially enclose electronics compartment 244. Inverter or other power electronics may be attached directly to top plate 248 so that they are contained within electronics compartment 244.

In order to seal electronics enclosure 242 from the outside elements and safely contain all electronic components within electronics compartment 244, electronics assembly 240 may further include a seal 250 positioned between electronics enclosure 242 and top plate 248. For example, seal 250 may be an O-ring formed from an elastomeric or rubber material such that it is resilient and is compressed when top plate 248 is attached to electronics enclosure 242. In this regard, for example, top plate 248 may be mounted to electronics enclosure 242 using one or more mechanical fasteners 252. In addition, it should be appreciated that top plate 248 defines a footprint that is larger than an outer flange 260 of electronics enclosure 242. In this manner, positioning top plate 248 over opening 246 substantially seals opening 246 and forms a single, enclosed electronics compartment 244.

In addition, as best illustrated in FIG. 16, electronics enclosure 242, or more specifically outer flange 260, defines a perimeter groove 262 that extends around a perimeter of electronics enclosure 242 and is configured for receiving seal 250. Moreover, electronics enclosure 242 may define a wire recess 264, e.g., through which wires are routed via a grommet to auxiliary fan 120. Wire recess 264 may also define a recess groove 266 for partially receiving seal 250. In this manner, seal 250 has a single, continuous grooved pathway defined around all mating surfaces between electronics enclosure 242, top plate 248, and grommet (not shown).

According to an exemplary embodiment, top plate 248 is formed to be a thermally conductive member for allowing heat to escape electronics compartment 244. In this regard, for example, top plate 248 may define or include a heat sink 270. In addition, top plate 248 may be constructed of a thermally conductive material, such as aluminum. By contrast, electronics enclosure 242 may be formed from a thermoset plastic or any other suitable material. According still another embodiment, electronics enclosure 242 may also be formed from a thermally conductive material, such as metal or aluminum.

As best illustrated in FIGS. 11, 12, 16, and 17, fan assembly 100 may further define features for simplifying the assembly of electronics enclosure 242 to fan duct 102. In this regard, fan duct 102 may define one or more mounting pads 280 that protrude from fan duct 102 and electronics enclosure 242 may define one or more mounting recess 282. As used herein, "mounting pads" are features that are configured for receipt within "mounting recesses" to align and mount electronics enclosure 242 to fan duct 102. It should be appreciated that although fan duct 102 is illustrated as defining mounting pads 280 and electronics enclosure 242 is illustrated as defining recesses 282, the two features could be swapped. In this regard, electronics enclosure 242 could instead define mounting pads 280 and fan duct 102 could instead define recesses 282. Other configurations are possible and within scope of the present subject matter.

Moreover, according to an exemplary embodiment, mounting pads 280 and mounting recesses 282 are configured for receiving an adhesive for joining electronics enclosure 242 and fan duct 102. These features may further define profiles simplify the alignment assembly of electronics enclosure 242 and fan duct 102. For example, according to the illustrated embodiment upper portion 140 of fan duct 102 defines two L-shaped mounting pads 280 that are configured for engaging a bottom 284 and a back 286 of electronics enclosure 242. In this manner, assembly of fan assembly 100 is simplified because a technician can easily align electronics enclosure 242 onto fan duct 102 by sliding it along the L-shaped mounting pads 280 until they contact back 286. In addition, upper portion 140 also defines a lateral mounting pad 280 that is configured to engage outer flange 260 of electronics enclosure 242. In sum, these features simplify the alignment and positioning of fan duct 102 and electronics enclosure 242 as well as the assembly and installation of fan assembly 100.

Thus, electronics assembly 240 and electronics enclosure 242 described herein are capable of housing electronics components safely and securely within an outdoor environment. Top plate 248 of electronics enclosure 242 includes heat sink 270 having a larger footprint than electronics enclosure 242 to prevent fluid entry through opening 246. In addition, extruded O-ring seal 250 is positioned within a groove 262 formed within outer flange 260 of electronics enclosure 242 such that securing top plate 248 to electronics enclosure 242 compresses the O-ring and seals electronics compartment 244.

Moreover, fan duct 102 and electronics enclosure 242 are permanently adhered together using an adhesive. More specifically, mounting pads 280 and complementary recesses 282 may be defined on fan duct 102 and electronics enclosure 242. These mounting pads 280 and recesses 282 interact or engage each other to provide adhesive locations for permanently attaching fan duct 102 to electronics enclosure 242. Fan duct 102 and electronics enclosure 242 may be assembled prior to final installation into air conditioner unit 10, thereby making the integration of the make-up air features less labor intensive and easier to service.

As described above, fan assembly 100 includes fan duct 102 which is molded as two pieces that are joined together using an adhesive, thereby simplifying tooling and ensuring easy assembly. In addition, each piece may be compression molded from a thermoset material or another flame resistant material, allowing for simple mold tooling and part formation. The thermoset materials and adhesive used to join the two pieces exhibit inherent flame retardant properties, which is particularly important because fan duct 102 is positioned in a region where flame propagation is a concern.

Moreover, forming fan duct 102 as described herein allows fan duct 102 to have unique shapes and geometry for reducing the propagation of noise through fan duct 102 and vent aperture 80. In this regard, for example, fan duct 102 has an asymmetrical or offset arrangement along the transverse direction T, e.g., such that there is no direct line of sight between inlet 106 and outlet 108 along the transverse direction T. Moreover, fan duct 102 may protrude rearward, e.g., past outdoor fan shroud 36 and proximate rear grill 22, such that inlet 106 is positioned in a region where effects of the negative pressures developed by outdoor fan 32 may be reduced or avoided.

In addition, a unique construction of auxiliary fan 120 is provided which may reduce noise generated by auxiliary fan 120. For example, conventional axial fans generated blade "growl" or fluttering, particularly when the fan is shut off or changes speeds. This noise may have a tendency to propagate through fan duct 102, producing unacceptable noise within the room or indoor portion 12. However, auxiliary fan 120 described above may include more blades 210, a stabilizer ring 216, and blade geometries that results in a significantly quieter operation. For example, the rate of change of rotational speed of auxiliary fan 120 is lower due to higher inertia, the increased number of blades and their geometry deflect outside to inside noise transmission, etc. The fan construction, duct construction, and other noise isolating features provide an acoustic advantage to air conditioner unit 10 described herein.

In this manner, air conditioner unit 10 includes fan assembly 100 which has fan duct 102 and auxiliary fan 120 that provide the appropriate amount of make-up air to meet government regulations and building codes, keeps the noise created by fan assembly 100 to a minimum, and maintains guest comfort and satisfaction at a maximum. In addition, the manufacturing, assembly, and installation of fan assembly 100 are simplified, tooling costs are reduced, and the reliability and performance of air conditioner unit 10 is improved. Other advantages and benefits will be apparent to those having skill in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit comprising:
- a wall sleeve;
- a bulkhead positioned within the wall sleeve and defining an indoor portion and an outdoor portion;
- a vent aperture defined through the bulkhead for providing fluid communication between the indoor portion and the outdoor portion;
- a fan duct attached to the bulkhead and defining a flow passage in fluid communication with the vent aperture; and
- an electronics assembly comprising:
  - an electronics enclosure mounted to the fan duct and defining an electronics compartment having an opening;
  - a top plate attachable over the opening of the electronics enclosure to enclose the electronics compartment; and
  - a heat sink defined on an exterior surface of the top plate.

2. The packaged terminal air conditioner unit of claim 1, wherein the electronics assembly comprises:
- a seal positioned between the electronics enclosure and the top plate.

3. The packaged terminal air conditioner unit of claim 2, wherein the seal is an O-ring formed from an elastomeric or rubber material.

4. The packaged terminal air conditioner unit of claim 2, wherein the electronics enclosure defines a perimeter groove for at least partially receiving the seal.

5. The packaged terminal air conditioner unit of claim 4, wherein the electronics enclosure defines a wire recess, the wire recess defining a recess groove for at least partially receiving the seal.

6. The packaged terminal air conditioner unit of claim 1, wherein the top plate is mounted to the electronics enclosure using a plurality of mechanical fasteners.

7. The packaged terminal air conditioner unit of claim 1, wherein the top plate of the electronics enclosure is constructed of a thermally conductive material.

8. The packaged terminal air conditioner unit of claim 7, wherein the thermally conductive material is aluminum.

9. The packaged terminal air conditioner unit of claim 1, wherein the electronics enclosure is formed from a thermoset plastic.

10. The packaged terminal air conditioner unit of claim 1, wherein the electronics assembly is positioned within the outdoor portion.

11. The packaged terminal air conditioner unit of claim 1, wherein the fan duct defines one or more mounting pads that protrude from the fan duct, and wherein the electronics enclosure defines one or more mounting recesses, the mounting recesses configured for receiving the mounting pads to mount the electronics enclosure to the fan duct.

12. The packaged terminal air conditioner unit of claim 11, wherein at least one of the mounting pads is L-shaped such that it extends along a bottom side and wraps around a back side of the electronics enclosure.

13. The packaged terminal air conditioner unit of claim 11, further comprising:

an adhesive joining the mounting pads and the mounting recesses to couple the electronics enclosure to the fan duct.

14. The packaged terminal air conditioner unit of claim 1, wherein the electronics enclosure defines one or more mounting pads that protrude from the electronics enclosure, and wherein the fan duct defines one or more mounting recesses, the mounting recesses configured for receiving the mounting pads to mount the electronics enclosure to the fan duct.

15. An electronics assembly for a packaged terminal air conditioner unit, the packaged terminal air conditioner unit comprising a wall sleeve and a bulkhead positioned within the wall sleeve and defining a vent aperture and a fan duct mounted to the bulkhead over the vent aperture, the electronics assembly comprising:

an electronics enclosure mounted to the fan duct and defining an electronics compartment having an opening;

a top plate attachable over the opening of the electronics enclosure to enclose the electronics compartment; and a heat sink defined on an exterior surface of the top plate.

16. The electronics assembly of claim 15, wherein the electronics enclosure defines a perimeter groove and the electronics assembly comprises:

a seal positioned within the perimeter groove between the electronics enclosure and the top plate.

17. The electronics assembly of claim 15, wherein the top plate of the electronics enclosure is constructed of a thermally conductive material and the electronics enclosure is formed from a thermoset plastic.

18. The electronics assembly of claim 15, wherein the fan duct defines one or more mounting pads that protrude from the fan duct, and wherein the electronics enclosure defines one or more mounting recesses, the mounting recesses configured for receiving the mounting pads to mount the electronics enclosure to the fan duct.

* * * * *